US007950381B2

(12) United States Patent
Maeda

(10) Patent No.: US 7,950,381 B2
(45) Date of Patent: May 31, 2011

(54) MAGAZINE EJECTOR STRUCTURE FOR AIR GUN

(75) Inventor: Tetsuo Maeda, Tokyo (JP)

(73) Assignee: Maruzen Company Limited, Toyko (JP)

( * ) Notice: Subject to any disclaimer, the term of this patent is extended or adjusted under 35 U.S.C. 154(b) by 451 days.

(21) Appl. No.: 12/068,999

(22) Filed: Feb. 14, 2008

(65) Prior Publication Data

US 2009/0056690 A1 Mar. 5, 2009

(30) Foreign Application Priority Data

Aug. 28, 2007 (JP) ..... 2007-221320

(51) Int. Cl.
*F41F 1/00* (2006.01)

(52) U.S. Cl. ..... 124/51.1; 124/45; 124/48; 124/52; 124/56; 124/74; 42/6; 42/7; 42/19; 42/49.01

(58) Field of Classification Search ..... 124/45, 124/51.1, 52, 82, 48, 74, 87; 42/6, 7, 49.01, 42/19

See application file for complete search history.

(56) References Cited

U.S. PATENT DOCUMENTS

| | | | | | |
|---|---|---|---|---|---|
| 1,314,013 | A | * | 8/1919 | Mulvey | 42/19 |
| 1,360,410 | A | * | 11/1920 | Jones | 124/29 |
| 2,031,433 | A | * | 2/1936 | Sosso | 42/19 |
| 2,737,942 | A | * | 3/1956 | Horowitz et al. | 124/37 |
| 2,855,715 | A | * | 10/1958 | Weimer | 42/58 |
| 2,894,346 | A | * | 7/1959 | Smith | 42/69.03 |
| 3,111,121 | A | * | 11/1963 | Baggott | 124/67 |
| 3,239,959 | A | * | 3/1966 | Sefried et al. | 42/19 |
| 3,302,523 | A | * | 2/1967 | Adams et al. | 89/7 |
| 3,548,802 | A | * | 12/1970 | Green | 124/70 |
| 3,695,246 | A | * | 10/1972 | Filippi et al. | 124/72 |
| 3,818,887 | A | * | 6/1974 | Akiyama et al. | 124/67 |
| 4,471,549 | A | * | 9/1984 | Brint et al. | 42/15 |
| 4,567,810 | A | * | 2/1986 | Preston | 89/142 |
| 4,602,608 | A | * | 7/1986 | Lacam et al. | 124/74 |
| 4,619,062 | A | * | 10/1986 | Johnson | 42/70.11 |
| 4,619,063 | A | * | 10/1986 | Hill et al. | 42/7 |
| 4,834,058 | A | * | 5/1989 | Gegere | 124/29 |

(Continued)

FOREIGN PATENT DOCUMENTS

CN 2136973 Y 6/1993

(Continued)

OTHER PUBLICATIONS

Extended European Search Report, App. No. 08003586.8-1260, Mar. 8, 2010 (6 pages).

(Continued)

*Primary Examiner* — Gene Kim
*Assistant Examiner* — Alexander R Niconovich
(74) *Attorney, Agent, or Firm* — Rader, Fishman & Grauer PLLC

(57) ABSTRACT

A magazine has a magazine body provided with a rotary clip, and the magazine body comprises an ejector member capable of movement, an ejector elastic member provided on the ejector member and being capable of expansion and contraction, and an engagement indent section capable of being engaged with a magazine catch at the time of loading the magazine into the air gun body, and the air gun body has a magazine ejector structure with the magazine catch that is urged by a catch elastic member to the magazine holding section and capable of engaging with the engagement indent section of the magazine, and a stopper that is capable of pressing part of the ejector member.

2 Claims, 4 Drawing Sheets

U.S. PATENT DOCUMENTS

| | | | | |
|---|---|---|---|---|
| 4,914,845 | A * | 4/1990 | Reese et al. | 42/40 |
| 5,160,795 | A * | 11/1992 | Milliman | 42/65 |
| 5,165,383 | A * | 11/1992 | Ebert et al. | 124/74 |
| 5,400,536 | A * | 3/1995 | Milliman | 42/65 |
| 5,404,863 | A * | 4/1995 | Poor | 124/74 |
| 5,456,153 | A * | 10/1995 | Bentley et al. | 89/33.02 |
| 5,476,087 | A * | 12/1995 | Kunimoto | 124/73 |
| 5,477,843 | A * | 12/1995 | Kunimoto | 124/73 |
| 5,520,171 | A * | 5/1996 | David | 124/51.1 |
| 5,561,258 | A * | 10/1996 | Bentley et al. | 89/33.17 |
| 5,600,083 | A * | 2/1997 | Bentley et al. | 89/33.02 |
| 5,608,981 | A * | 3/1997 | Canaday | 42/25 |
| 5,704,150 | A * | 1/1998 | Milliman | 42/67 |
| 5,711,286 | A * | 1/1998 | Petrosyan et al. | 124/73 |
| 5,835,978 | A * | 11/1998 | Canaday et al. | 89/138 |
| 6,026,797 | A * | 2/2000 | Maeda et al. | 124/74 |
| 6,112,734 | A * | 9/2000 | Kunimoto | 124/73 |
| 6,158,424 | A * | 12/2000 | Kunimoto | 124/73 |
| 6,257,116 | B1 * | 7/2001 | Moczijdlower et al. | 89/155 |
| 6,497,229 | B1 * | 12/2002 | Maeda | 124/76 |
| 6,578,565 | B2 * | 6/2003 | Casas Salva | 124/73 |
| 6,601,496 | B1 * | 8/2003 | Kalashnikov et al. | 89/33.02 |
| 6,640,480 | B2 * | 11/2003 | Williams et al. | 42/95 |
| 6,729,322 | B2 * | 5/2004 | Schavone | 124/72 |
| 6,745,755 | B2 * | 6/2004 | Piccini | 124/49 |
| 6,820,608 | B2 * | 11/2004 | Schavone | 124/74 |
| 6,874,492 | B1 * | 4/2005 | Schavone | 124/31 |
| 6,877,265 | B2 * | 4/2005 | Hajjar et al. | 42/19 |
| 7,025,052 | B2 * | 4/2006 | Schavone | 124/74 |
| 7,047,686 | B2 * | 5/2006 | Zimmermann | 42/75.1 |
| 7,159,584 | B2 * | 1/2007 | Maeda et al. | 124/41.1 |
| RE39,805 | E * | 9/2007 | Maeda et al. | 124/74 |
| 7,267,119 | B2 * | 9/2007 | Maeda et al. | 124/73 |
| 7,290,539 | B2 * | 11/2007 | Maeda et al. | 124/74 |
| 7,318,294 | B2 * | 1/2008 | Zimmermann | 42/7 |
| 7,353,816 | B2 * | 4/2008 | Maeda et al. | 124/73 |
| 7,530,191 | B2 * | 5/2009 | Szabo | 42/50 |
| 7,669,588 | B2 * | 3/2010 | Maeda | 124/74 |
| 2001/0022131 | A1 * | 9/2001 | Moczijdlower et al. | 89/155 |
| 2003/0106545 | A1 * | 6/2003 | Verini | 124/74 |
| 2004/0074486 | A1 * | 4/2004 | Schavone | 124/56 |
| 2004/0237952 | A1 * | 12/2004 | Maeda et al. | 124/56 |
| 2005/0072415 | A1 * | 4/2005 | Schavone | 124/31 |
| 2005/0241204 | A1 * | 11/2005 | Hajjar et al. | 42/19 |
| 2006/0042613 | A1 * | 3/2006 | Hu | 124/48 |
| 2006/0162711 | A1 * | 7/2006 | Maeda et al. | 124/73 |
| 2006/0260596 | A1 * | 11/2006 | Maeda et al. | 124/74 |
| 2006/0272192 | A1 * | 12/2006 | Zimmermann | 42/7 |
| 2007/0151551 | A1 * | 7/2007 | Verini | 124/74 |
| 2008/0017180 | A1 * | 1/2008 | Maeda et al. | 124/74 |
| 2009/0056692 | A1 * | 3/2009 | Maeda | 124/63 |
| 2009/0139506 | A1 * | 6/2009 | Maeda | 124/41.1 |
| 2009/0139507 | A1 * | 6/2009 | Maeda | 124/48 |
| 2009/0235910 | A1 * | 9/2009 | Maeda | 124/52 |
| 2010/0031944 | A1 * | 2/2010 | Maeda | 124/74 |

FOREIGN PATENT DOCUMENTS

| | | | |
|---|---|---|---|
| DE | 195 42 332 | C1 | 5/1997 |
| EP | 1 677 066 | A1 | 7/2006 |
| GB | 430484 | A | 6/1935 |
| TW | 373065 | | 11/1999 |
| TW | 410971 | | 11/2000 |
| TW | M279841 | | 11/2005 |
| TW | M283153 | | 12/2005 |
| TW | I270652 | B | 1/2007 |

OTHER PUBLICATIONS

Taiwan IPO Search Report, App. No. 96140609, Oct. 23, 2009 (1 page).

* cited by examiner

MAGAZINE EJECTOR STRUCTURE FOR AIR GUN

BACKGROUND OF THE INVENTION

1. Field of the Invention

The present invention relates, in the field of air guns, to a magazine ejector structure for air gun having a structure where a magazine is inserted into and removed from a magazine holding section of an air gun body, and in particular to a magazine ejector structure for an air gun that ejects (spits out) a magazine that has been provided with rotary clip (rotary cylinder, rotary magazine) in an end section of magazine body of a rectangular solid shape, from the air gun body.

2. Description of the Related Art

This type of conventional air gun magazine is constructed from a substantially magazine body of a rectangular solid shape provided with a rotary clip(s) at one or both ends, and this magazine is held in a magazine holding section formed from a cavity in the air gun body.

A magazine that has been inserted into the magazine holding section is ejected from the magazine holding section once all bullets contained in the rotary clip have been fired, and after reloading the empty a rotary clip with bullets it is fitted into the magazine holding section.

Conventionally, there is known an air gun of a structure having part or all of a magazine body of a magazine exposed from an opening of the air gun body (related art 1).

There is also known an air gun of a structure having a gap provided between a magazine holding section of the air gun body and the magazine body of the magazine, and dropping down under its own weight (related art 2).

However, with related art 1, if the section of the magazine body that is exposed from the air gun body is small, there is no effect, while conversely if a lot of the magazine body is exposed it is more likely that foreign bodies will become attached or infiltrate inside, and there is a problem that it is easy to cause damage. Further, if the magazine body of the magazine is exposed from the air gun, there is a problem that the external appearance is detrimentally affected.

Also, with related art 2, since a gap is provided between a magazine holding section of the air gun body and the magazine body of the magazine, there is a problem that the probability of operational malfunctions arising is high. There is also a possibility of the magazine not being able to drop under its own weight due to foreign matter infiltrating into the gap.

SUMMARY OF THE INVENTION

In order to solve the above-described problems, there is proposed, in an air gun having an air gun body and a magazine that is fitted into and removed from a magazine holding section of the air gun body, a magazine ejector structure, wherein the magazine has a magazine body of a rectangular solid shape provided with a clip at at least one end; and the magazine body comprises an ejector capable of moving in the longitudinal direction of the body;

an ejector elastic member, provided on the ejector member, capable of expanding and contracting between part of the ejector member and part of the magazine body; and an engagement indent capable of engaging with a magazine catch when fitted to the air gun body, and the air gun body comprises a magazine catch, urged by a catch elastic member into a holding space for fitting the magazine, and being capable of engaging with the engagement indent of the magazine; and a stopper, projecting to the magazine holding section, capable of pressing part of the ejector member at the time of fitting the magazine.

According to the present invention, since it is possible to completely insert a magazine into the inside of a magazine holding section of the air gun, the magazine does not project from the air gun body and there is the effect that there is no problem with the external appearance.

Also, at the time of eject (spitting out), by removing a magazine catch, which is an engagement section, the magazine is ejected from the air gun body by the urging force of the elastic member, which means that there is no need to have a large gap between the magazine holding section of the air gun body and the magazine body of the magazine, and it can be made as small as possible. Accordingly there is the effect that the occurrence of operational malfunction and infiltration of foreign matter, which are the two drawbacks the related art 2, are both extremely unlikely compared to the related art.

DESCRIPTION OF PREFERRED EMBODIMENTS

Figure 1:
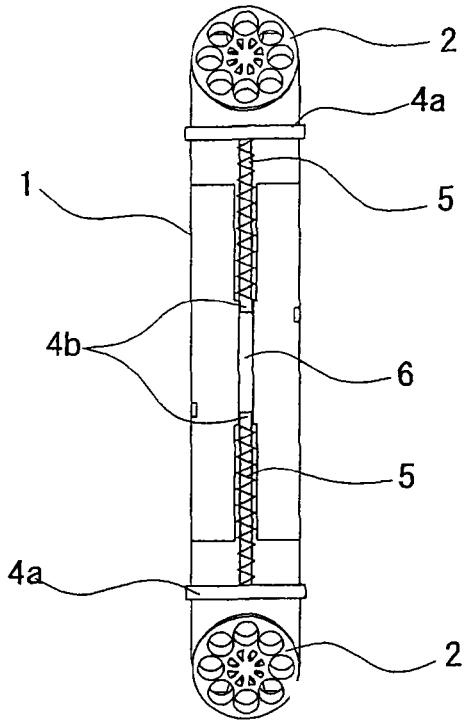
FIG. 1 is front elevation of a magazine having a magazine ejector structure for an air gun of an embodiment of the present invention.
Figure 2:
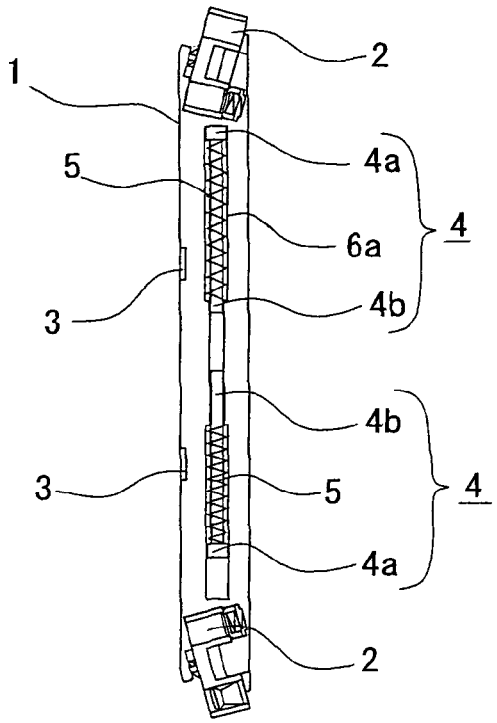
FIG. 2 is a side elevation of a magazine having a magazine ejector structure for an air gun of an embodiment of the present invention.
Figure 3:
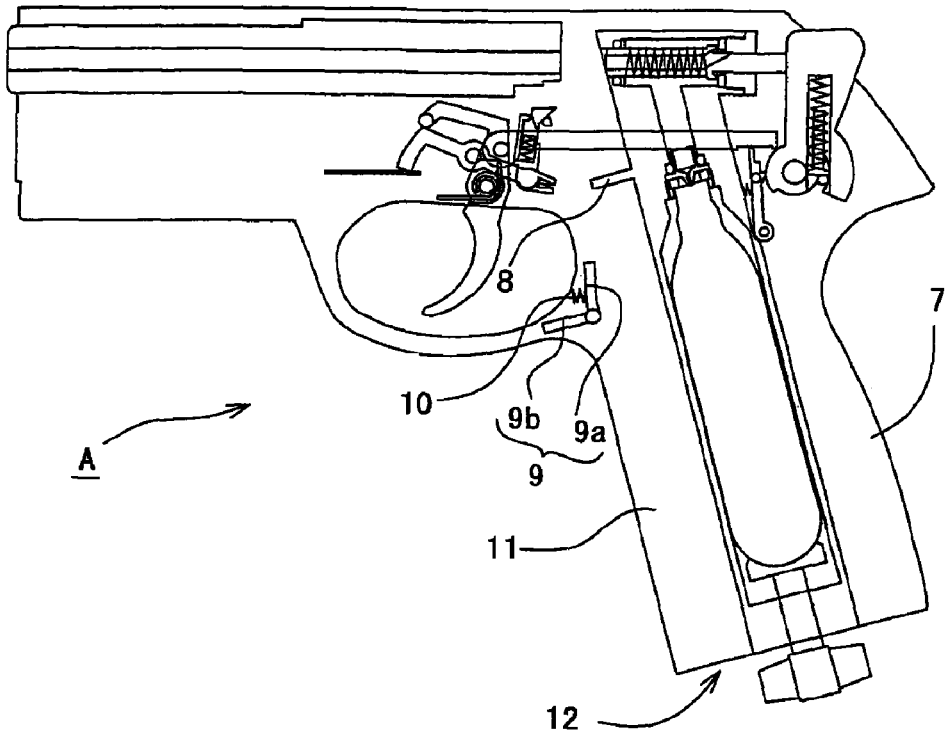
FIG. 3 is a side elevation explanatory drawing of an air gun body having the magazine ejector structure for an air gun of an embodiment of the present invention.
Figure 4:
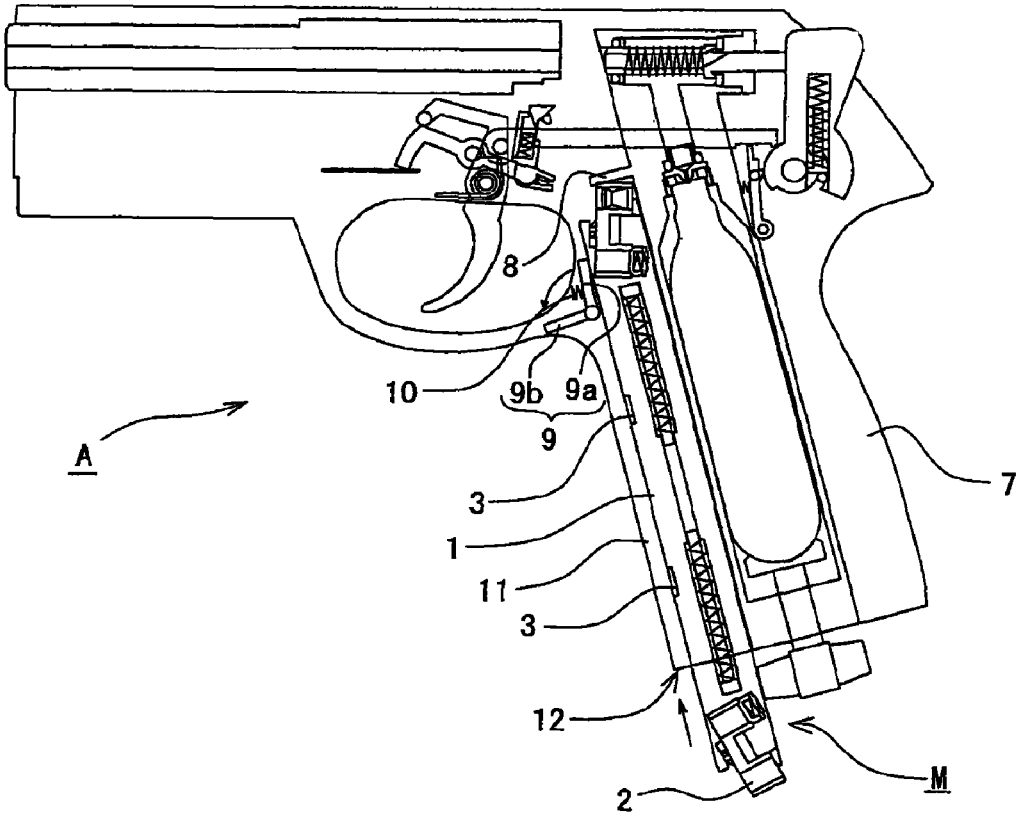
FIG. 4 is a side elevation explanatory drawing showing operation of inserting the magazine of this invention into an air gun body of the present invention, for the magazine having a magazine ejector structure for an air gun of an embodiment of the present invention.
Figure 5:
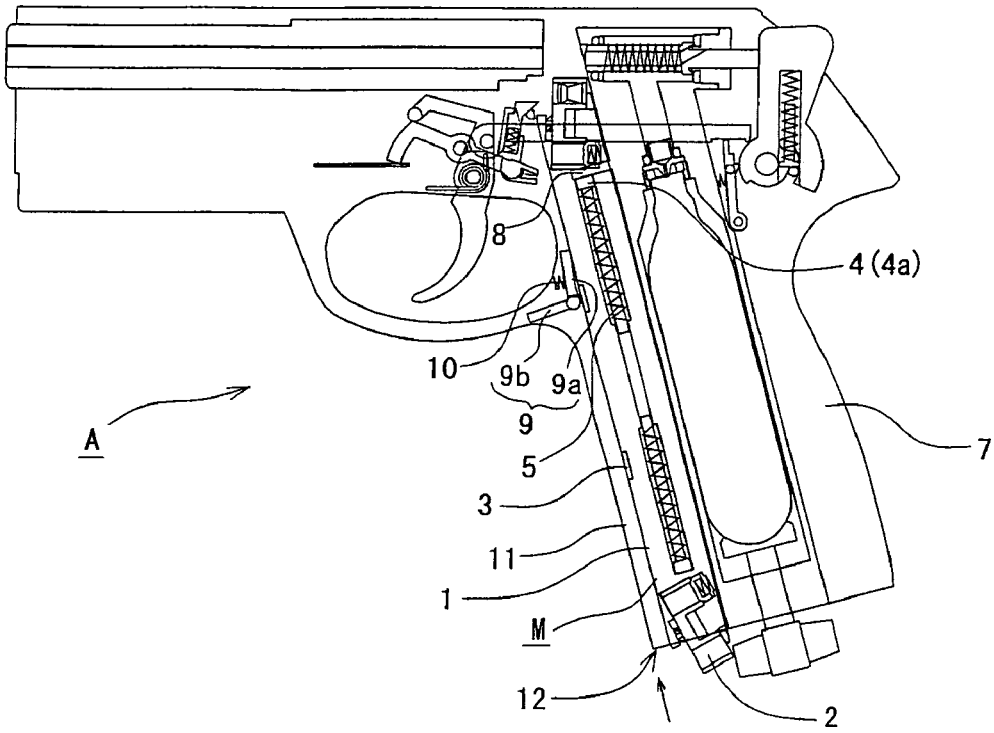
FIG. 5 is a side elevation explanatory drawing showing operation of inserting the magazine of this invention into an air gun body of the present invention, for the magazine having a magazine ejector structure for an air gun of an embodiment of the present invention.

Description will now be given based on FIG. 1, which is front elevation of a magazine having a magazine ejector structure for an air gun of an embodiment of the present invention, FIG. 2, which is a side elevation of a magazine having a magazine ejector structure for an air gun of an embodiment of the present invention, FIG. 3, which is a side elevation explanatory drawing of an air gun body having the magazine ejector structure for an air gun of an embodiment of the present invention, FIG. 4, which is a side elevation explanatory drawing showing operation of inserting the magazine of this invention into an air gun body of the present invention, for the magazine having a magazine ejector structure for an air gun of an embodiment of the present invention, FIG. 5 is, which a side elevation explanatory drawing showing operation of inserting the magazine of this invention into an air gun body of the present invention, for the magazine having a magazine ejector structure for an air gun of an embodiment of the present invention, FIG. 6, which is a side elevation explanatory drawing showing a state where the magazine of this invention is completely inserted into an air gun body of the present invention, for the magazine having a magazine ejector structure for an air gun of an embodiment of the present invention, FIG. 7, which is a side elevation explanatory drawing, of the magazine having the magazine ejector structure for an air gun of an embodiment of the present invention, showing a state during ejection of that magazine from the air gun body of the present invention, and FIG. 8 which is front elevation expanded view, of the magazine having the magazine ejector structure for an air gun of an embodiment of the present invention.

An air gun of an embodiment of the present invention is an air gun formed from a magazine M and an air gun body A. The magazine ejector structure of this embodiment of the invention will be described for the magazine M and the air gun body A. A magazine M that is freely detachable from the air gun body A that is the embodiment of the invention has a magazine body 1, formed from a rectangular solid shaped box body provided with a rotary clip 2 (rotary clips), provided on at least one end section, in this embodiment on both end sections. BB shot or pellet shot is loaded into each bores of the rotary clip 2.

The rectangular solid shaped magazine body 1 has an ejector member 4 capable of moving in a longitudinal direction internally, an ejector elastic member 5, provided on the ejector member 4 and capable of being compressed and expanded between part of the ejector member 4 and part of the magazine body 1, and an engagement indent 3 provided on a surface constituting a front side surface at the time of fitting to the air gun A, respectively provided two at a time in a symmetrical fashion facing in opposite directions on both sides, with the middle of the magazine body 1, in a longitudinal direction, as a center.

With this embodiment, the ejector member 4 is formed from a T-shaped member. The T-shaped member 4 is comprised of a rod-shaped T-support section 4*b* facing in the longitudinal direction of the magazine body 1, and a rod-shaped T-head section 4*a* facing in a width direction, with the T-support section 4*b* being capable of movement inside a movement path 6 provided in a longitudinal direction of the magazine body 1, and the T-head section 4 projecting from a side surface opening section 6*a* of the movement path 6 and being capable of movement.

With this embodiment, the ejector elastic member 5 is formed from a spring coil. The spring coil 5 is provided at the outer periphery of the rod-shaped T-support section 4*b,* with one end being in contact with the T-head section 4*a,* and the other end in contact with or fixed to part of the movement path 6 of the magazine body 1, and is configured so as to be capable of compression and expansion between the T-head section 4*a* and part of the movement path 6.

The air gun body A is provided with a magazine holding section 11, which is a holding space for loading the magazine M, at a muzzle side of the handle section 7. The magazine holding section 11 is provided with an opening section 12 in a lower end section of the handle section 7. The magazine holding section 11 is provided with a catch elastic member 10 at a muzzle side, and has a magazine catch 9 that is urged towards the rear by the catch elastic member 10, and a stopper 8 that projects from both side surfaces inside the magazine holding section 11.

Figure 8:
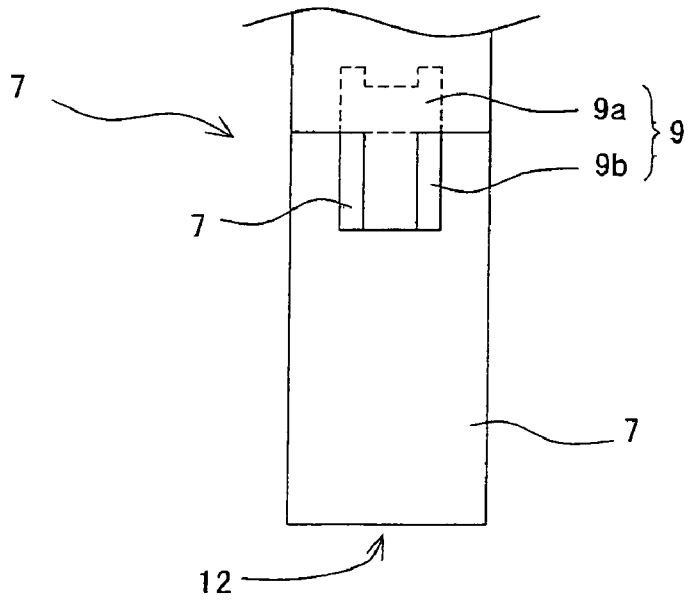
FIG. 8 is front elevation expanded view, of the magazine having the magazine ejector structure for an air gun of an embodiment of the present invention, of essential sections of a magazine catch of the present invention looking from a shooting opening.

The magazine catch 9 is a side surface L-shaped plate body, and as shown in FIG. 8, is comprised of an internal catch section 9*a* positioned inside the air gun body A and provided at a position corresponding to the engagement indent 3 of the magazine body 1 of the inserted magazine M, and an external catch section 9*b* positioned outside the air gun body A and capable of being operated by the hand of a contestant etc. The internal catch section 9*a* is capable of being engaged or released from the engagement indent section 3 of the magazine body 1 of the inserted magazine M.

The catch elastic member 10 is formed from a spring coil in this embodiment, and urges the internal catch section 9*a* of the magazine catch 9 towards the rear of the magazine.

The stopper 8 is a projecting section projecting from left and right side surfaces of the magazine holding section 11, and is capable of pressing the ejector member 4 against the urging force of the ejector elastic member 5 by coming into contact with the T-shaped two end sections of the ejector member 4 when loading the magazine M.

Next, the embodiment of this invention will be described based on FIG. 4 to FIG. 7 showing the operation of inserting and spitting out (ejecting) the magazine M into and out of the air gun body A.

BB shot or pellet shot are loaded into each bores of a rotary clip 2 which are at both end sections of the magazine M. Magagine M is inserted from an opening section 12 opening to a lower end of the handle section 7 into the magazine holding section 11 of the magazine body A. The magazine M can also be similarly inserted from either end section as it has a symmetrically identical structure about a center line in the longitudinal direction.

The magazine M has the magazine body 1 inserted into the magazine holding section 11 from the opening section 12, but a lateral clearance of the stopper 8 projecting in a protruding shape from the left and right side surfaces at halfway points is for passing the rotary clip 2, but is a clearance where contact is made from above with the T-head section 4*a* of the T-shaped member 4 that is the ejector member. The T-shaped member 4 can not go upwards from the position of the stopper 8, but the magazine body 1 is inserted in that state as far as the uppermost section (see FIG. 6). Therefore, the T-shaped member 4 has the T-support section 4*b* of the T-shaped member 4 move downwards inside the movement path 6 against the urging force of the ejector elastic member 5, and the T-head section 4*a* projects from the left and right side surface opening section 6*a* and moves downwards.

Figure 6:
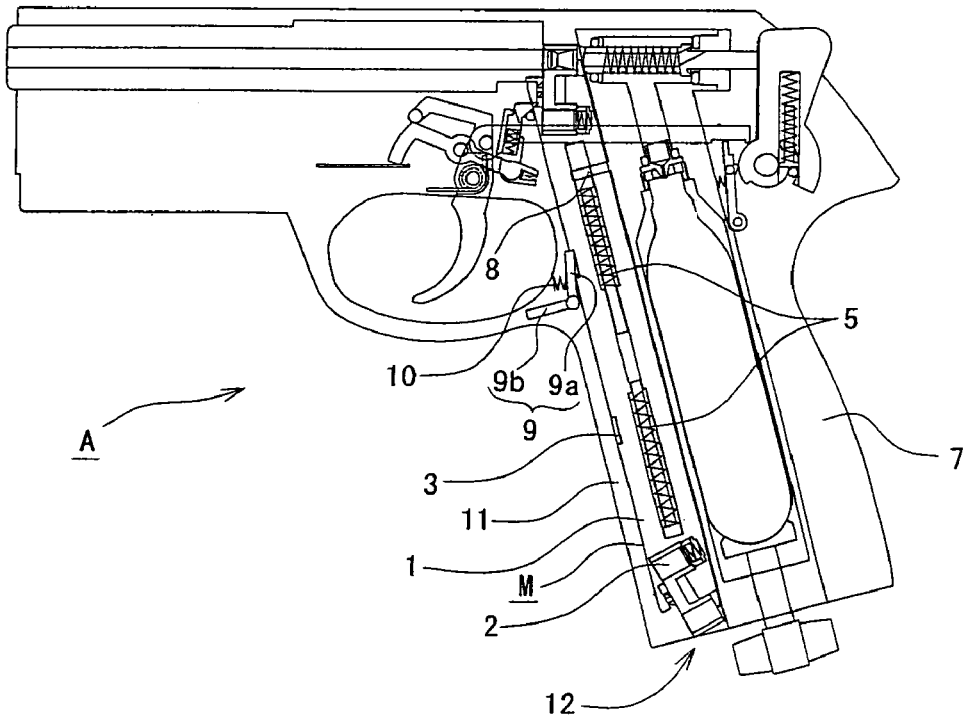
FIG. 6 is a side elevation explanatory drawing showing a state where the magazine of this invention is completely inserted into an air gun body of the present invention, for the magazine having a magazine ejector structure for an air gun of an embodiment of the present invention.
Figure 7:
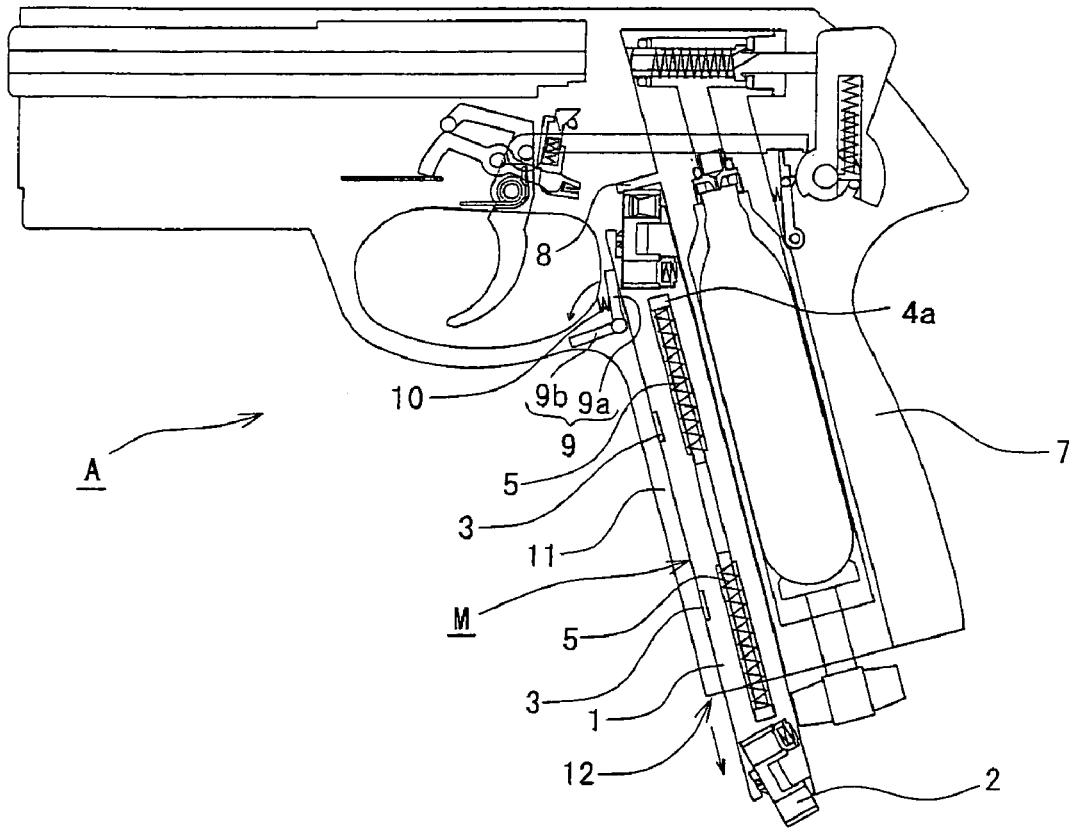
FIG. 7 is a side elevation explanatory drawing, of the magazine having the magazine ejector structure for an air gun of an embodiment of the present invention, showing a state during ejection (spitting out) of that magazine from the air gun body of the present invention.

As shown in FIG. 6, if the magazine body 1 is inserted as far as the uppermost section, the engagement indent 3 of the magazine body 1 is engaged by the internal catch section 9*a* of the magazine catch 9, by the urging force of the catch elastic member 10 of the air gun body A, preventing the magazine body 1 dropping out.

Next, in the event that the magazine M is ejected from the air gun body A, the contestant etc. rotates the external catch section 9*b* of the magazine catch 9 downwards from outside the air gun body A, and if the internal catch section 9*a* is removed from the engagement indent 3 against the urging force of the catch elastic member 10 the ejector elastic member 5 is compressed by the stopper 8, and as a result the whole of the magazine body 1 is popped out by this urging force, and it is possible to remove the magazine M to the outside at that instant from the opening section 12.

What is claimed is:

1. An air gun, comprising:

a magazine including:

a magazine body having an elongated shape provided with a rotary clip located on at least one end;

an ejector member capable of moving in a longitudinal direction of the magazine body;

an ejector elastic member housed inside the magazine body and capable of expanding and contracting between the ejector member and the magazine body; and an engagement indent formed into the magazine, and an air gun body including:

a magazine holding section defining a holding space in which the magazine is fitted into and removed from;

a magazine catch sized and operative for engaging the engagement indent, the magazine catch being pivotably connected to the air gun body and resiliently biased to move to engage the engagement indent;

a catch elastic member urging the magazine catch into the holding space; and a stopper fixedly connected to the magazine holding section and projecting into the holding space, wherein, in a loading mode, when the magazine is inserted into the holding space in an insertion direction, the stopper contacts the ejector member to compress the ejector elastic member to create an urging force that resists insertion of the magazine into the holding space and the magazine catch is in slidable contact with the magazine body at least immediately before engagement with the engagement indent, in a loaded mode, the magazine catch pivots to engage with the engagement indent to retain the magazine in a stationary condition in the holding space and against the urging force and in an ejection mode, when the magazine catch pivots to disengage from the engagement indent, the urging force from the ejector elastic member on the stopper causes the magazine to be ejected, at least partially, from the holding space in an ejection direction being opposite to the insertion direction.

2. The air gun of claim 1, wherein the magazine catch includes:

an internal catch section capable of engaging the engagement indent of the magazine in the holding space; and an external catch section expanding from the internal catch section and operated by a user.

* * * * *